US012376679B2

(12) United States Patent
Bouwknegt et al.

(10) Patent No.: US 12,376,679 B2
(45) Date of Patent: Aug. 5, 2025

(54) ADJUSTABLE CHAIR

(71) Applicant: NPK Design B.V., Leiden (NL)

(72) Inventors: Janwillem Bouwknegt, Leiden (NL); Joseph Elisabeth Oberdorf, Leiden (NL)

(73) Assignee: NPK DESIGN B.V., Leiden (NL)

( * ) Notice: Subject to any disclaimer, the term of this patent is extended or adjusted under 35 U.S.C. 154(b) by 27 days.

(21) Appl. No.: 18/026,077

(22) PCT Filed: Sep. 14, 2021

(86) PCT No.: PCT/NL2021/050557
§ 371 (c)(1),
(2) Date: Mar. 13, 2023

(87) PCT Pub. No.: WO2022/060221
PCT Pub. Date: Mar. 24, 2022

(65) Prior Publication Data
US 2023/0329436 A1 Oct. 19, 2023

(30) Foreign Application Priority Data
Sep. 16, 2020 (NL) ..... 2026485

(51) Int. Cl.
*A47C 1/032* (2006.01)
*A47C 3/025* (2006.01)
(Continued)

(52) U.S. Cl.
CPC ..... *A47C 1/03255* (2013.01); *A47C 1/03288* (2013.01); *A47C 3/025* (2013.01); *A47C 3/027* (2013.01); *A47C 7/448* (2013.01)

(58) Field of Classification Search
CPC ..... A47C 1/03255; A47C 1/03288; A47C 3/0252; A47C 3/027; A47C 7/448
See application file for complete search history.

(56) References Cited

U.S. PATENT DOCUMENTS 273,630 A * 3/1883 Stevens ..... A47C 3/027 297/262.1
317,933 A * 5/1885 Doubler ..... A47C 3/027 297/262.1
(Continued)

FOREIGN PATENT DOCUMENTS

DE 202005011725 U1 12/2006
FR 2533428 A1 3/1984
(Continued)

OTHER PUBLICATIONS

International Search Report and Written Opinion in corresponding International Patent Application No. PCT/NL2021/050557 dated Jan. 18, 2021.

*Primary Examiner* — Rodney B White
(74) *Attorney, Agent, or Firm* — Westman, Champlin & Koehler, P.A.; Steven M. Koehler

(57) ABSTRACT

A piece of furniture comprises a seat, a backrest and a base. At least the seat and the base are movably coupled for reversible relative adjustment in a direction from a first configuration for sitting upright to a second configuration for sitting reclined. One or more support surfaces and a lever are operably coupled to support the seat on the base. The lever rotates about an axis transverse to the seating direction and moves being coupled with the one or more support surfaces at a first support portion defining first lever arm about the axis and a second, different, support portion defining a second, different, lever arm about the axis. The one or more support surfaces define a curved, noncircular path about the axis, such that relative displacement of the support surface and the axis in the seating direction is associated with rotation of the lever about the axis.

19 Claims, 13 Drawing Sheets

(51) Int. Cl.
*A47C 3/027* (2006.01)
*A47C 7/44* (2006.01)

(56) References Cited

U.S. PATENT DOCUMENTS 346,311 A * 7/1886 Parry ..... A47C 3/026 297/262.1
834,670 A * 10/1906 Hartzler ..... A63G 11/00 297/262.1
3,361,472 A * 1/1968 Hasbrouck ..... A47C 1/0246 297/354.12
4,383,714 A * 5/1983 Ishida ..... A47C 3/03 297/261.3
4,732,424 A 3/1988 Uredat-Neuhoff
4,842,333 A 6/1989 Meiller
5,048,893 A * 9/1991 Cowan ..... A47C 3/0257 297/313
5,150,948 A 9/1992 Volkle
5,314,237 A 5/1994 Koepke et al.
5,333,368 A * 8/1994 Kriener ..... A47C 7/444 297/303.3
5,366,274 A 11/1994 Roericht et al.
5,577,802 A * 11/1996 Cowan ..... A47C 3/0257 297/303.2
5,603,551 A * 2/1997 Sheehan ..... A47C 3/0257 297/216.19
6,588,843 B1 * 7/2003 Ebenstein ..... A47C 1/031 297/301.4
6,945,602 B2 * 9/2005 Fookes ..... A47C 1/03261 297/300.4
7,234,772 B2 * 6/2007 Wells ..... A47C 3/027 297/316
7,396,080 B2 * 7/2008 Suhr ..... A47C 7/14 297/313
7,497,515 B2 * 3/2009 Krehm ..... A47C 7/443 297/303.2
7,513,569 B2 4/2009 Curiger
7,600,814 B2 * 10/2009 Link ..... A47C 1/03255 297/300.5
8,662,586 B2 * 3/2014 Serber ..... A47C 3/0257 297/316
9,211,013 B2 * 12/2015 Harrison ..... A47C 7/448
9,462,889 B2 * 10/2016 Piretti ..... A47C 1/03255
9,629,465 B2 * 4/2017 Williams ..... A47C 3/18
9,713,381 B2 7/2017 Davis et al.
10,231,546 B2 * 3/2019 Loew ..... A47C 3/22
10,743,667 B2 * 8/2020 Loew ..... A47C 3/22
10,772,427 B2 * 9/2020 Schuppler ..... A47C 7/44
11,166,553 B2 * 11/2021 Vogtherr ..... A47C 7/44
11,229,291 B1 * 1/2022 Collier ..... A47C 7/029
11,825,949 B2 * 11/2023 Collier ..... A47C 7/443
11,969,094 B2 * 4/2024 Schmitz ..... A47C 1/032
12,022,950 B2 * 7/2024 Donati ..... A47C 1/03255
12,029,319 B2 * 7/2024 Lin ..... A47C 7/448
2006/0103221 A1 5/2006 Kleist
2011/0193384 A1 * 8/2011 Ni ..... A47C 1/026 297/311
2013/0221719 A1 * 8/2013 Costaglia ..... A47C 1/03255 297/340
2016/0128483 A1 * 5/2016 Gorgi ..... A47C 4/021 297/440.2
2022/0117396 A1 * 4/2022 Taylor, II ..... A47C 1/03288
2023/0263306 A1 * 8/2023 Bisman ..... A47C 1/03288 297/300.1

FOREIGN PATENT DOCUMENTS

WO 2008020824 A2 2/2008
WO 2012032336 A1 3/2012
WO 2013177175 A1 11/2013

* cited by examiner

ADJUSTABLE CHAIR

CROSS-REFERENCE TO RELATED APPLICATION(S)

This Application is a Section 371 National Stage Application of International Application No. PCT/NL2021/050557, filed Sep. 14, 2021, and published as WO 2022/060221 A1 on Mar. 24, 2022, and further claims priority to Netherlands Patent Application No. 2026485, filed Sep. 16, 2020.

TECHNICAL FIELD

The present disclosure relates to sitting furniture, in particular a reclining chair, more in particular an office chair, comprising a seat and a backrest supported by a base and movably connected with each other for adjustment between a first configuration for sitting in an upright posture and a second configuration for sitting in a reclined posture, preferably in one or more postures in between, possibly any posture in between.

BACKGROUND

In the densely populated field of seating furniture reclining chairs of the aforementioned type are well known.

Chairs should accommodate the body's movement as much as possible for comfort.

A reclining chair allows pivoting of the seated user's body. The pivoting should preferably be about an axis of rotation extending through the user's hips. Preferably, opening up of the body's posture should be accommodated, i.e. increasing an angle between the torso and upper legs, also involving an axis of rotation extending through the user's hips. If the pivoting axis of rotation is not coordinated with the natural body action, undesired friction and/or the well-known problem of "shirt tail pull" may occur.

Further desires comprise that both when sitting upright and when sitting reclined, and preferably when shifting between the two postures, the user's feet may remain on the floor, preferably allowing constant pressure (i.e. no lifting of the feet from the floor and no need to support more weight and/or to prop the user into the chair); and/or that localised pressure on the underside of the legs and/or inside of the knees is prevented, so as not to hinder blood flow; and/or that the user's eye level may remain substantially constant.

It has been found that in known reclining chairs these issues are not satisfactory solved, at least not in combination.

Further desires in are that other ranges of movement of the body than pure straight reclining, such as sideways flexing, e.g. when leaning and/or reaching over and/or when turning such as when looking over a shoulder, be accommodated while at least part of the user's body maintains contact with and/or remains support by the chair, in particular the torso; thus "active sitting" would be accommodated or even promoted. Still further desires are reductions in costs and/or in effort and/or in environmental impact (e.g. consumption of materials and/or of energy and/or of other resources) for one or more of materials, manufacturing, transport, maintenance, repair, disassembly, recycling.

In view of the foregoing, further improvements in reclining chairs are therefore still sought after and considered to be provided by the present chair.

SUMMARY

To address one or more of the issues considered above, herewith is provided a piece of sitting furniture, in particular a reclining chair, more in particular an office chair, comprising a seat, a backrest and a base. At least the seat and the base are movably coupled for reversible relative adjustment in a seating direction from a first configuration for sitting in an upright posture to a second configuration for sitting in a reclined posture, and preferably in one or more, possibly any, intervening configurations and associated intervening sitting postures in between. The piece of sitting furniture comprises one or more support surfaces and a lever operably coupled to support the seat on the base in at least the first and second configurations, and preferably in one or more, possibly any, intervening configurations. The lever is rotary about a lever axis transverse to the seating direction and movably and operably coupled with the one or more support surfaces at a first support portion defining first lever arm about the lever axis and a second, different, support portion defining a second, different, lever arm about the lever axis. The one or more support surfaces define a curved path that is noncircular about the lever axis, such that relative displacement of the support surface and the lever axis in the seating direction is associated with rotation of the lever about the lever axis.

Thus, the seat and the base are adjustable relative to each other in a front-back direction into the first configuration and the second configuration and preferably one or more configurations in between, more preferably continuously.

The piece of sitting furniture may be of any type, e.g. a chair, at least part of a chair assembly e.g. as in an airplane- or a theatre-seating row, at least part of a couch or a couch assembly, a stretcher, etc.

The piece of sitting furniture may be symmetric about the seating direction. For the second, reclined, configuration the seat may be moved forward on the base compared to the first, upright configuration, and the other way around. The lever and the one or more support surfaces cooperate to accommodate this forward-backward movement. Preferably, the seat may be adjusted one or more configurations between the first and second configurations, more preferably being continuously adjustable.

By the arrangement of the lever and the one or more support surfaces, a rotary path of the one or more support surfaces rotating around the lever axis differs from the curved path defined by the one or more support surfaces. Thus, one or more objects defining the one or more support surfaces may follow, relative to the lever axis, either of the two different paths or a compound path from a combination of the two. In the latter case the radial separation and/or an orientation of the one or more support surfaces relative to the lever axis may vary so that the curved path may be repositioned and/or reoriented with respect to the lever axis. A translation of the support relative to the lever axis causes a rotation of the lever about the lever axis and the other way around. Thus, the combined path facilitates providing a desired position and orientation of the seat relative to the base in at least the first and second configurations and possibly any configuration in between.

The first lever arm and the second lever arm may differ in direction to the lever axis, extending towards opposite sides from the lever axis and/or being non-parallel to each other. Also or alternatively, the first lever arm and the second lever arm may differ in length to the lever axis. E.g., the first and second support portions and the lever axis may be arranged in a triangular pattern which may be, or not, isosceles and/or rectangular.

The lever may have distinct arms and/or comprise a noncircular surface about the lever axis, e.g. a generally elliptical shape, moon shape or oval shape.

Herein, a description of a "circular shape" and words of similar nature may refer to a circle-segment only. A description of "noncircular shape or object about the lever axis" and words of similar nature mean that the respective shape or object has a nonconstant radial distance to the lever axis, e.g. being noncircular in a plane perpendicular to the lever axis and/or, in case of a portion that is circular in a plane perpendicular to the lever axis, having the circle-centre of the circular portion offset from the lever axis.

The lever may comprise one or more lever support surfaces defining a curved lever path matching the curved path for supporting the one or more support surfaces along the curved path. Then, the one or more support surfaces may form a substantially continuous surface along the curved path from and including the first support portion to and including the second support portion, and/or the one or more lever support surfaces form a substantially continuous surface along the curved lever path from the first lever support portion to the second lever support portion.

The first and second support portions may be portions of a continuous support surface. The lever may be operably coupled with the one more support surfaces in more than the first and second support portions, e.g. one or more further support portions may be provided in between.

The lever may comprise one or more lever support surfaces defining a curved lever path matching the curved path for supporting the one or more support surfaces along the curved path.

The one or more support surfaces may form a continuous surface along the curved path from and including the first support portion to and including the second support portion. The one or more lever support surfaces may form a continuous surface along the curved lever path from the first lever support portion to the second lever support portion.

The support surfaces and/or the lever support surfaces may comprise distinct portions, which may indicate different configurations. A continuous surface may facilitate uninterrupted adjustment between different configurations.

The one or more lever support surfaces may engage the one or more support surfaces. This may facilitate construction. The larger the engagement area the lower a contact pressure and associated friction and/or wear may be. One or more portions of the support surfaces and/or lever support surfaces may be provided with rollers and/or friction-reducing materials compared to other surface portions of the lever and/or a material providing the support surface. Typical low-friction materials are polyamide (nylon) and polytetrafluorethylene (PTFE, Teflon®).

The curved path may be circular. This facilitates relative movement of the lever and the one or more support surfaces in a well-defined path. Moreover it facilitates establishing and/or maintaining a desired orientation of the one or more support surfaces relative to one or more of the lever, the base and the seat, in particular in combination with a rotation of the lever about the lever axis.

In the first and/or the second configuration, the one or more support surfaces and/or the first and second support portions may extend to different vertical and/or horizontal positions about the lever axis.

In some embodiments the lever axis may be movable with respect to the base, e.g. at least part of the lever may be able to roll and lift the seat. For controlling such rolling the lever and the base and/or the seat may comprise mated teeth. Thus, movement of the lever axis may cause an elevation (and/or a rotation) of the seat with respect to the base.

Other embodiments may comprise that the lever axis is fixed with respect to one of the bases and the seat, preferably the base, and/or the at least one support surface is fixed with respect to the other one of the base and the seat, preferably the seat.

By such fixation of the lever axis the aforementioned rotary path about the lever axis is well defined. By such fixation of the at least one support surface the position of the support surface is well defined. A translation of the support relative to the lever axis causes a rotation of the lever and the other way around. The combination of both fixations restricts both the rotary path and the combined path.

Fixation of the lever axis may be provided by a pivot and/or a hinge. Fixation of the support surface may be provided by a shape the base or the seat itself or of a separate support member fixed to the base or the seat.

The seat and/or the backrest may comprise a self-supporting shell. This may facilitate construction.

The seat and/or the backrest may comprise or be formed as one or more felt layers. Felt is generally a low cost material that can be formed in arbitrary shapes and with predetermined rigidity and/or flexibility. The material is generally comfortable to the human touch. Felts may be manufactured from natural fibres such as wool and/or cotton and/or from artificial materials such as polyethylene terephthalate (PET) and/or polyethylene furanoate (PEF), which may comprise recyclable and/or recycled materials. At least part of the frame and/or base may be made of the same material(s), facilitating disassembly and/or recycling.

The backrest may be rotary coupled with the base about a backrest axis. Thus, tilting of the backrest from the first configuration into the second configuration and/or back is facilitated. The backrest axis may be defined by one or more pivots and it may be adjustable and/or be fixed with respect to the base and/or to the backrest.

The seat and the backrest may be movably coupled, in particular rotary coupled, for reversible combined motion from the first configuration into the second configuration.

When the backrest is rotary coupled with the base, and the backrest axis is generally horizontal and offset from an end of the backrest, the end of the backrest will trace a circular path section about the backrest axis, causing the end to move both horizontally and vertically. The backrest and seat being movably coupled allows coordinated motion between the backrest and the seat, a rotary coupling allows the angle between the backrest and the seat to vary.

Such arrangement may reduce or prevent the "shirt tail pull"-problem.

The movable coupling may be provided by one or more pivots and/or hinges. One or more of the hinges may be living hinges formed by one or more reversibly deformable portions of material connecting the seat and/or the backrest. The seat and backrest may comprise, or be formed as, a continuous and/or unitary piece of material forming at least part of both the seat and the backrest and connecting the two, such as a length of cloth, foil, leather, and/or other material. In such case the seat and backrest may be separated by the movable coupling.

In a refinement, the seat and the backrest are movably, in particular rotary, coupled for reversible combined motion from the first configuration into the second configuration by reversibly deformable couplings and/or rotary couplings defining non-parallel axes of rotation, in particular by rotary couplings on laterally opposite sides of the seat and backrest, respectively. Rotation of the seat and backrest with respect to each other about nonparallel axes of rotation provides a torque on the rotary couplings in order to get the axes of rotation aligned. Thus, the rotation may be counteracted by resiliency of the rotary couplings and/or mountings thereof providing both a feedback to the reclining movement as well as a force urging the seat and backrest back to a default position. Resiliency may be provided by the seat and/or backrest being formed of a resilient material, e.g. a shell of a resilient material. In case the axes are pointing rearwardly outward, i.e. rearwardly pointing away from a centre of a user's position, upon rotation the seat and backrest may be urged closed by the rotation and at least partial alignment of the axes increasing curvature and "scooping" the user when increasing the reclinement, thus increasing comfort.

The base may comprise a frame. The frame may support the backrest on laterally opposite sides. Also or alternatively, the frame and backrest may be rotary coupled on laterally opposite sides. Supporting the base on laterally opposite sides of the backrest may facilitate deformation of the backrest under load, e.g. when a user leans against the backrest. A rotary coupling on laterally opposite sides may facilitate construction for supporting the backrest in rotary fashion and may provide increased robustness.

At least part of the base and/or the backrest may be at least partially resilient, allowing sideways flexion and/or torsion about a vertical axis of rotation of at least part of the seat and/or backrest. The resiliency provides a restoring force and may assist reaching a default configuration of the piece of sitting furniture, e.g. the first configuration. In particular user comfort is increased when the sideways flexion and/or torsion about a vertical axis of rotation allows motion of the backrest relative to the seat, e.g. for leaning and/or reaching over sideways and/or over a user's shoulder. In particular, in an embodiment wherein the base comprises a frame, at least part of the frame may provide the resiliency.

At least part of the seat and at least part of the base may be movably coupled for reversible relative rotation about a vertical axis of rotation. Thus, (at least parts of) the seat and base may allow rotation. This may improve user comfort. In particular, the rotation may accommodate and/or accompany the flexion and/or torsion described above. This may increase the freedom of movement of a user and/or it may prevent stresses in the piece of sitting furniture itself.

One or more support surfaces and the lever may be operably coupled to support the seat on the base in at least two configurations differing with respect to a relative rotation about an axis generally perpendicular to the lever axis. In such embodiment, at least part of the operative coupling for the adjustment in the seating direction may serve for another degree of freedom. At least part of the support surfaces of such embodiment may also serve for the operative coupling for the adjustment in the seating direction. Thus, construction may be simplified and costs reduced.

In a particularly effective and possibly simple embodiment, at least part of the lever defines a curved lever support surface being curved in a direction parallel to the aforementioned axis generally perpendicular to the lever axis and to the lever axis in a plane spanned by both these axes. Preferably then also the one or more support surfaces define a curved support surface being curved a direction parallel to the lever axis, more in particular matching the curve lever support surface. In the latter case, at least part of the lever support surface and the curved lever support surface may define a saddle-shape surface and/or at least part of the curved support surface and the curved lever support surface may define a saddle-shape surface part and/or part of the lever and/or the support surface may provide a saddle point.

The saddle shape is preferably sloping downward towards the front and rear and sloping upward in lateral directions, the saddle point may be, at least in the first configuration centered with respect the front/back direction and with respect to the transverse directions. This may facilitate returning the seat to a default position and/or orientation as well as allowing rotation about a vertical axis. The saddle shape may be symmetric in lateral directions. The saddle shape may be symmetric in front/back directions. In case the backrest is rotary connected to the base on lateral sides and the backrest is (rotary) connected to the seat, the saddle shape may also have a lateral plane comprising the lever axis defining a front/back symmetry which plane is tilted backward on an upper side of the lever axis, which may increase a restoring force to the seat and/or backrest relative to symmetry with respect to a vertical plane.

At least one embodiment may be foldable, the seat being reversibly adjustable to a relatively vertical orientation. Then preferably the seat is stable in the relatively vertical orientation and/or the seat is reversibly fixable in the relatively vertical orientation so as to maintain the orientation. In such case, the piece of sitting furniture may occupy less place, which may be of advantage for one or more of transport, storage and use in dense arrangements such as theatres and/or airplanes. The stability of the seat may be provided in various ways, e.g. one or more of the seat resting against the backrest or another portion, the seat being weighted and/or balanced to the folded configuration when unoccupied and the provision of one or more resilient elements User comfort of the piece of sitting furniture may be further increased in one or more of the following:

at least part of the base is provided with a vertical adjustment mechanism for vertically adjusting at least part of the seat with respect to the base, and/or the base comprises one or more, preferably three, four or five, wheels. This facilitates adjustment to height and/or posture of a user and/or to the user's seating arrangement etc.

Also or alternatively the piece of sitting furniture may comprise an arm rest, preferably a pair of arm rests. Arm rests may be attached, preferably being removably attached, to at least part of the base and/or backrest, preferably adjacent at least part of the seat and/or preferably adjustable with respect to at least one of height, lateral position, forward/backward position, rotation about a vertical axis, and rotation about a horizontal axis. Such arm rests facilitate adjustment to a user's preference. However, at least partly fixed arm rests may be provided which may suit most (prospective) users and which may facilitate manufacturing.

BRIEF DESCRIPTION OF THE DRAWINGS

The above-described aspects will hereafter be more explained with further details and benefits with reference to the drawings showing a number of embodiments by way of example.

DETAILED DESCRIPTION OF EMBODIMENTS

Figure 1:
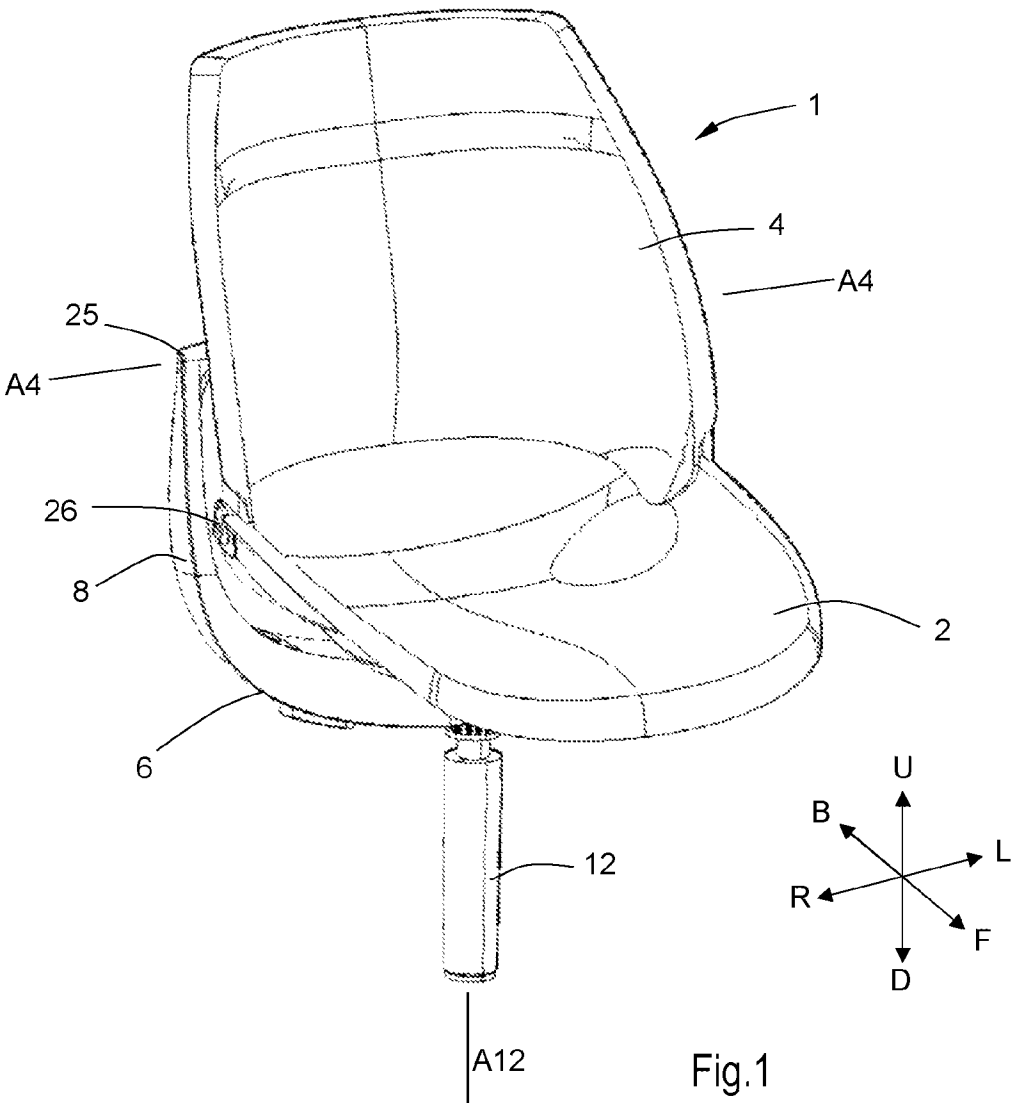
FIG. 1 is a perspective view of a reclining chair as provided herein.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, where helpful individualised with alphabetic suffixes; between different embodiments the reference numerals differ by hundreds.

Figure 2:
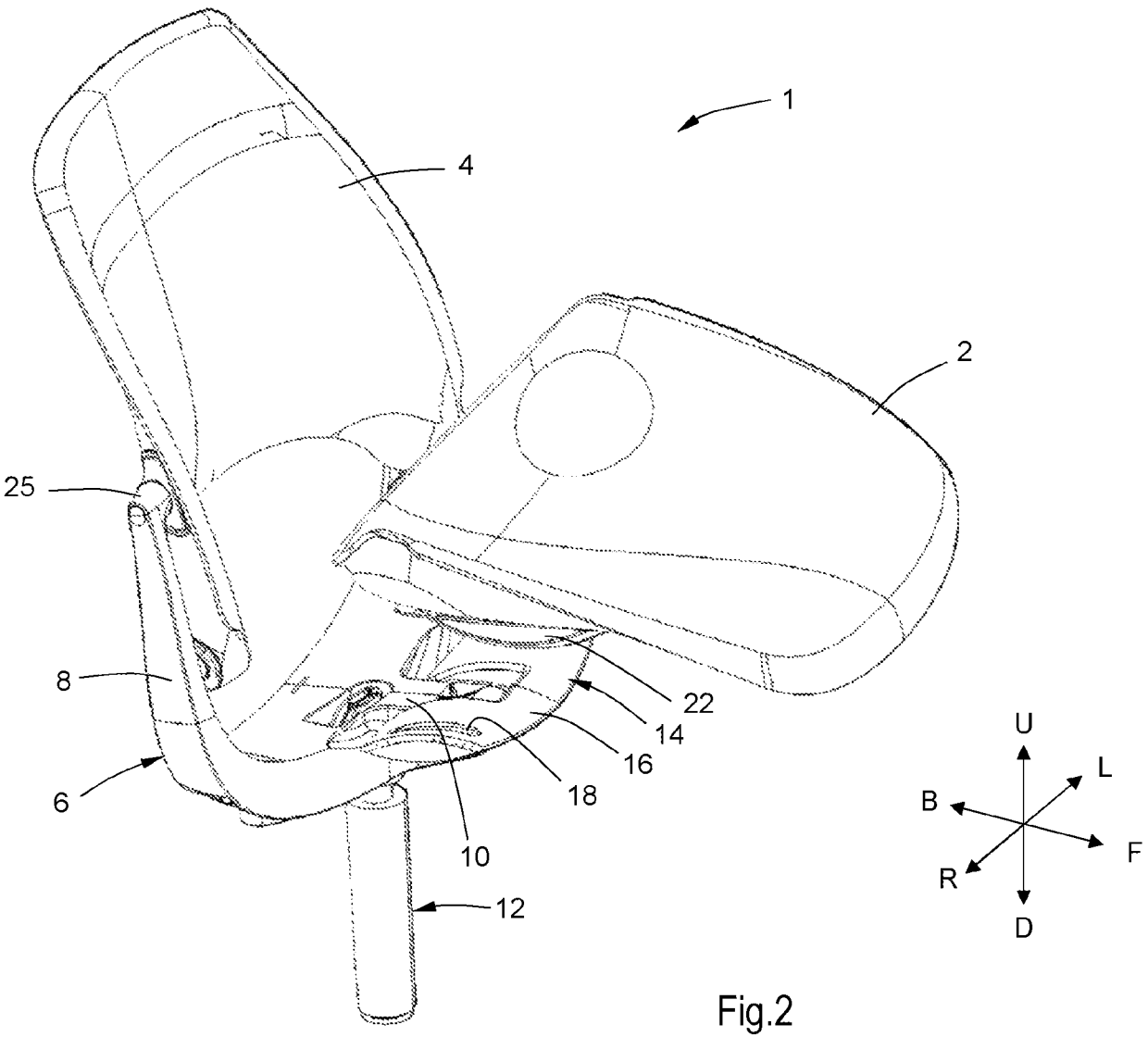
FIGS. 2, 3, and 4 are a partial exploded view of the chair in two viewing directions.
Figure 3:
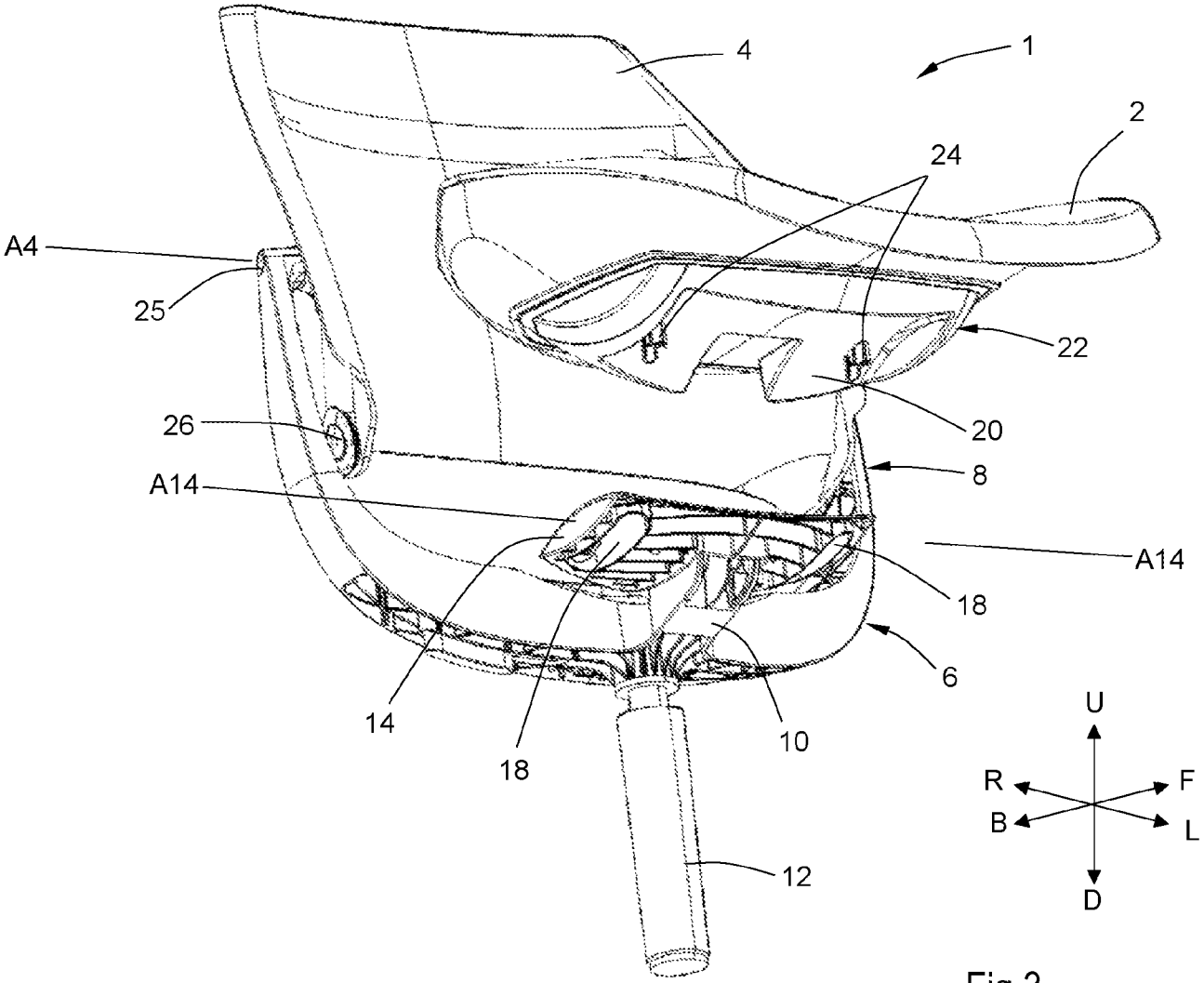
Figure 4:
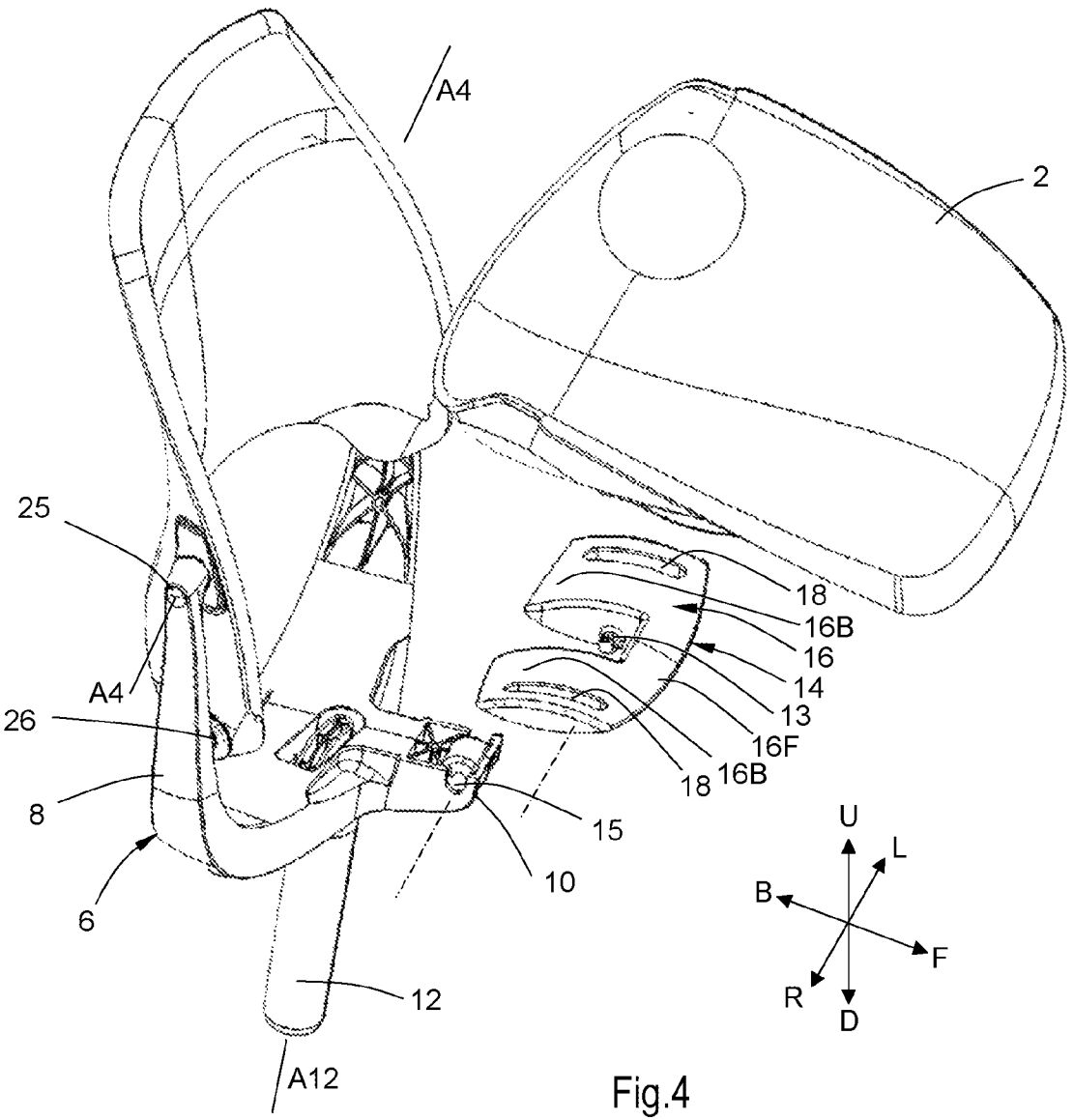
Figure 5A:
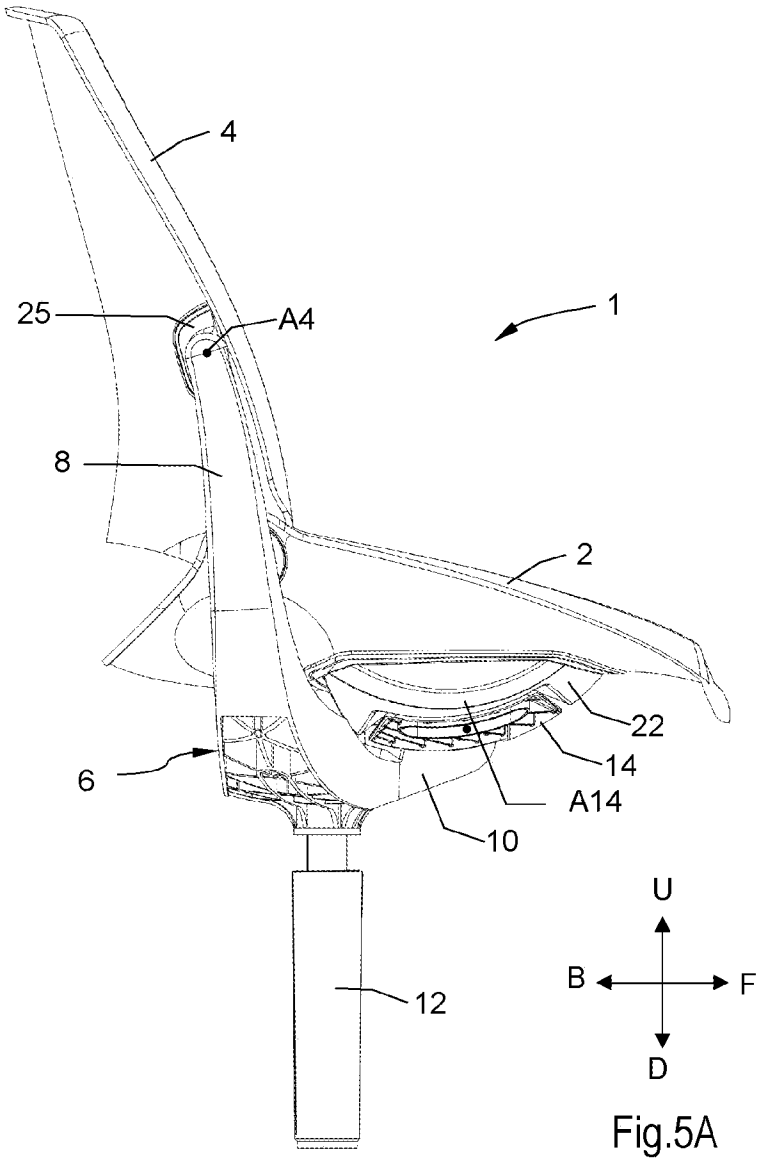
FIGS. 5A and 5B are a side view and a cross section view in a vertical front-back plane, respectively, of the chair in a first configuration.
Figure 5B:
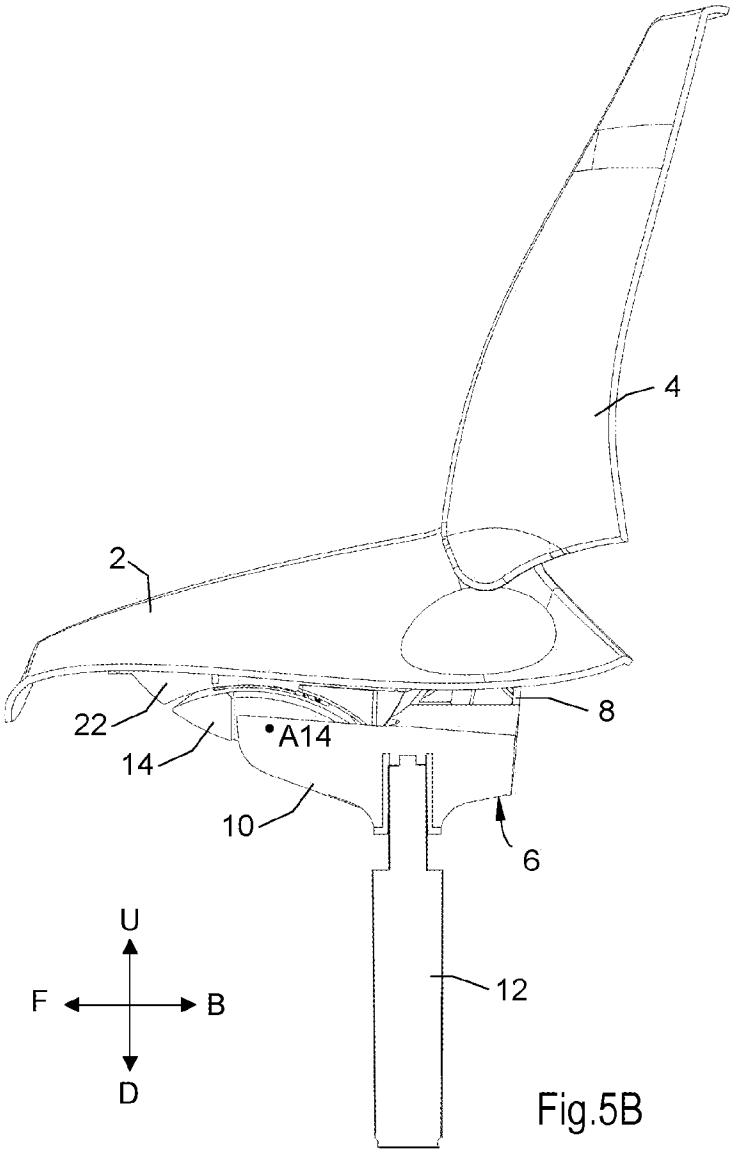
Figure 6A:
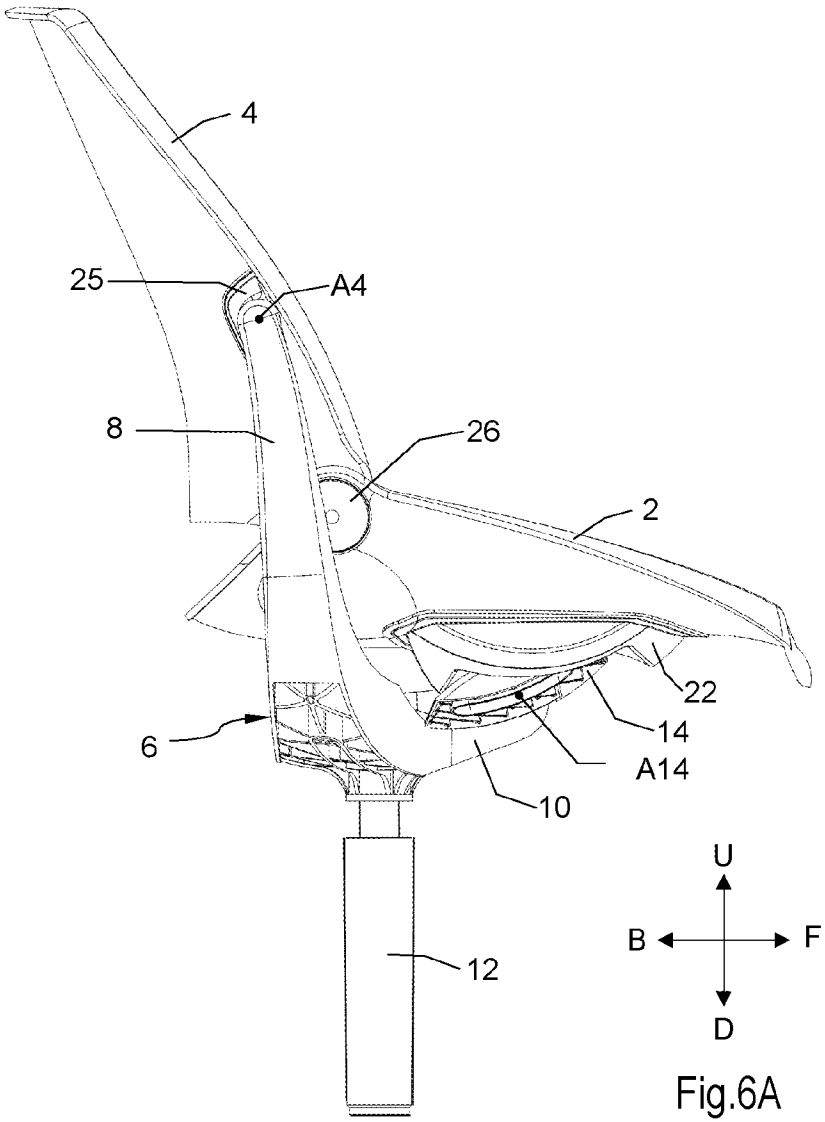
FIGS. 6A and 6B are views as in FIGS. 5A, 5B of the chair in an intermediate configuration.
Figure 6B:
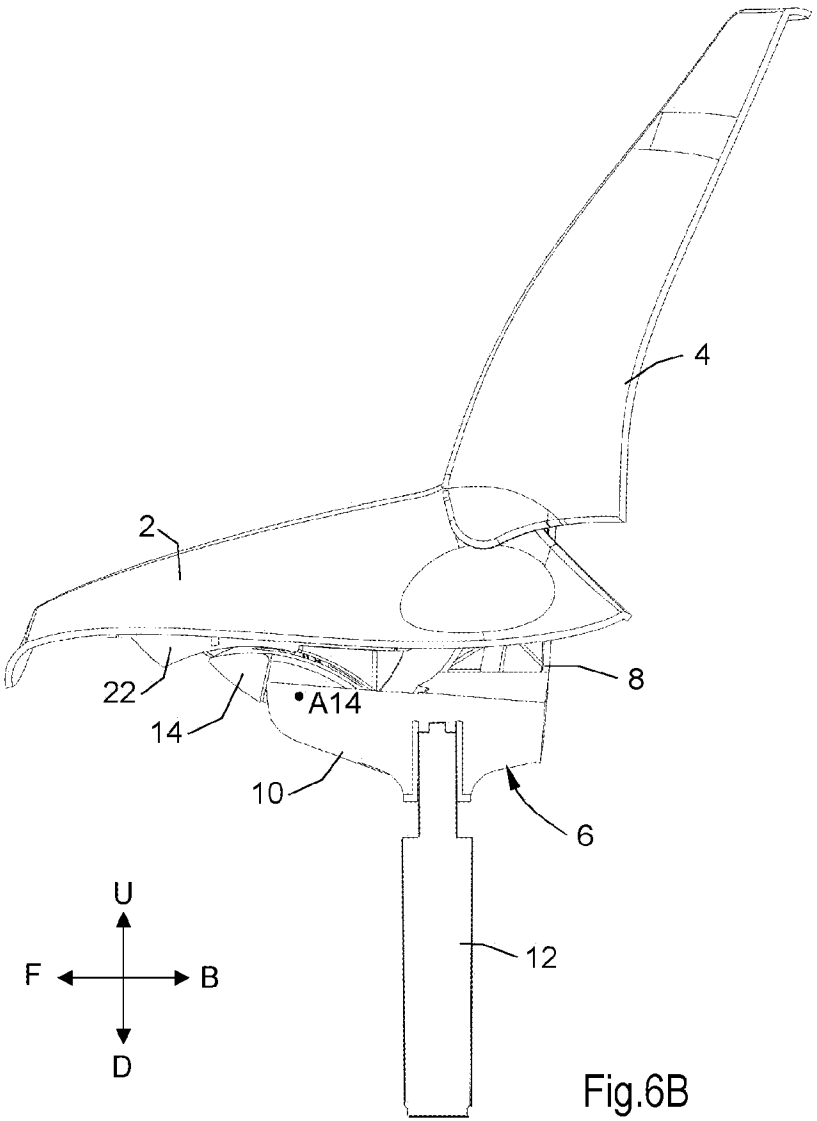
Figure 8:
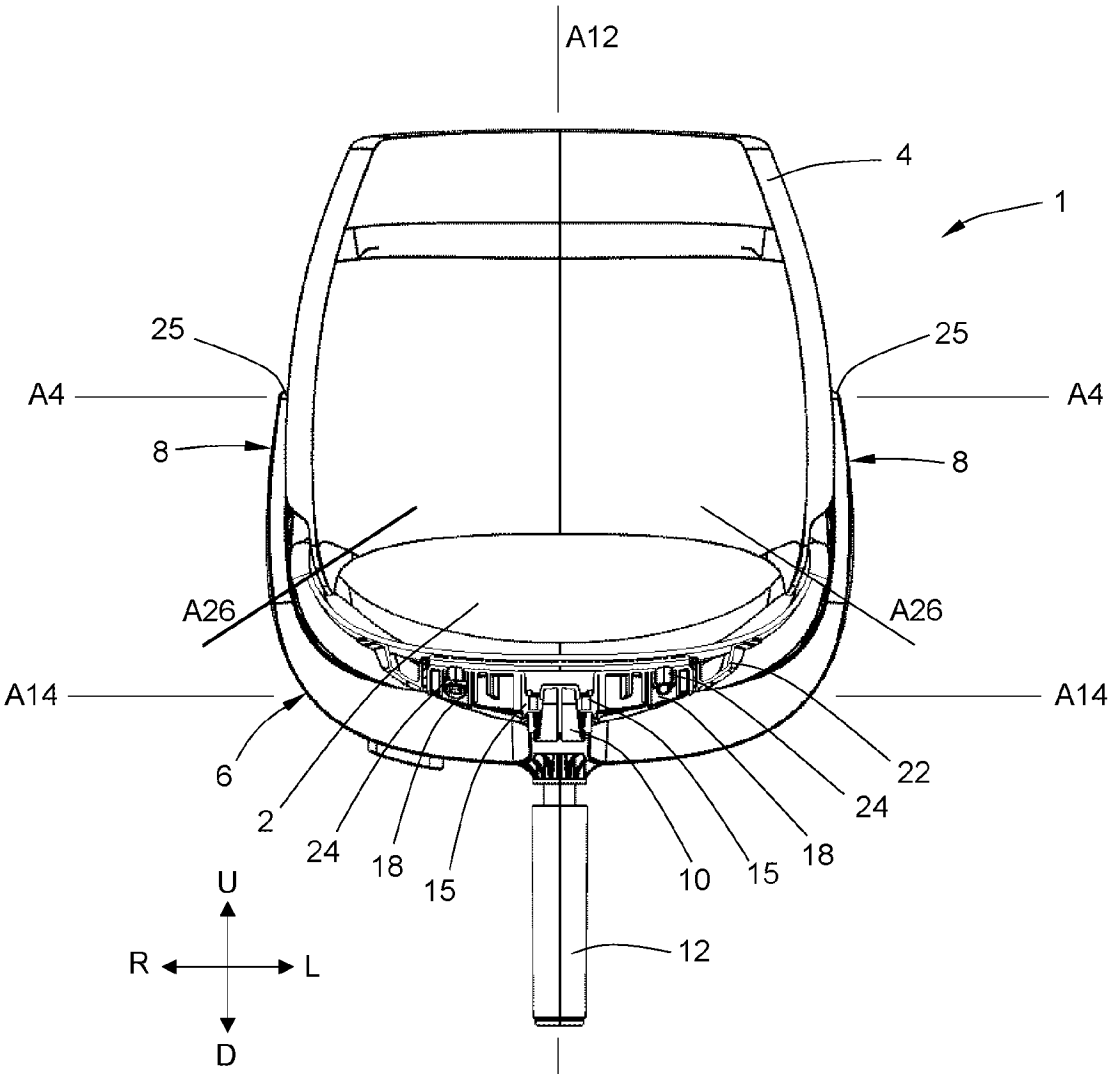
FIG. 8 is a cross section view in a vertical transverse plane, perpendicular to that of FIGS. 5B, 6B, 7B.
Figure 9:
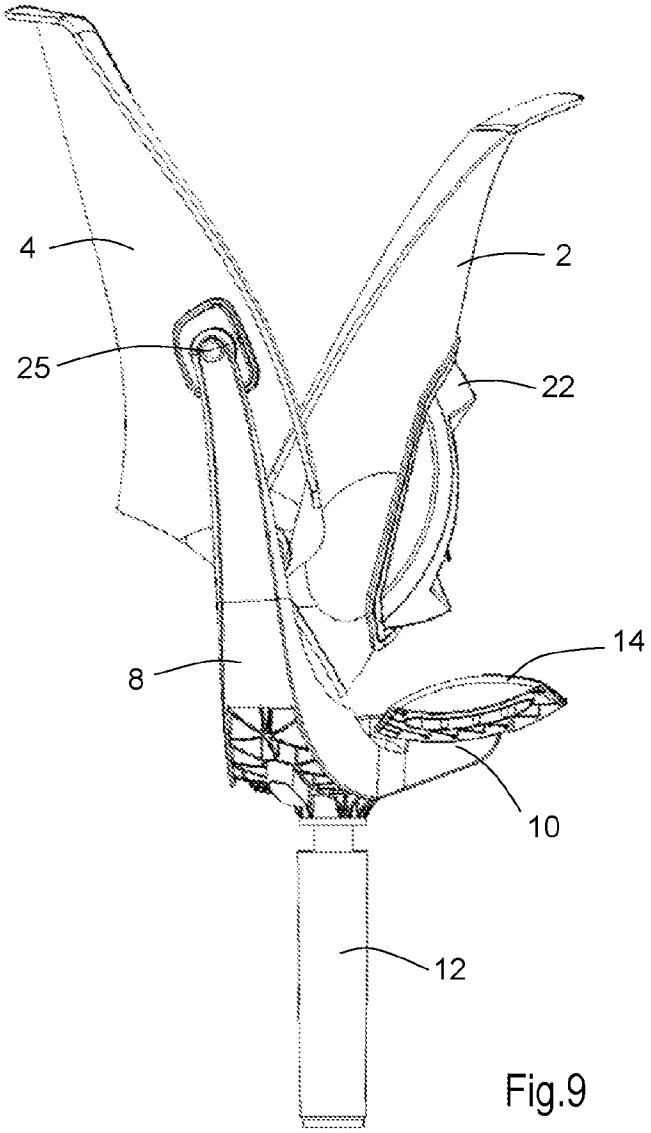
FIG. 9 is a side view of the chair of FIG. 1 in a folded configuration.

FIG. 1 is a perspective view of a reclining chair 1 as provided herein in a first configuration. FIGS. 2-4 are partial exploded views of the chair in different viewing directions. FIGS. 5A, 6A, 7A and 5B, 6B, 7B are side views and, respectively, cross section views in a vertical front-back plane of the chair of FIG. 1 in different configurations. FIG. 8 is a frontal cross section view and FIG. 9 shows the chair in yet another configuration.

The chair 1 shown in FIGS. 1-9 is formed as an office chair but it will be evident to the reader that the functionality of the chair may be beneficial for any type of sitting furniture. The chair comprises a seat 2, a backrest 4 and a base 6 supporting the seat 2 and the backrest 4. The base 6 comprises a frame 8, which here as an option is largely U-shaped, a seat support 10, which here as an option is integrated in the frame 8, and a stand 12.

For reference the following sides may be identified from a normal users' sitting perspective: front F, back B, left L, right R, up U and down D. The chair 1 provides a seating direction in the front-back direction (F/B).

The stand 12 shown in FIGS. 1-9 is of exemplary shape only and in embodiments the stand may be of any design and may e.g. comprise a pedestal (not shown) of any suitable type, e.g. a disc and/or a ring and/or or a number of radial legs which may be provided with wheels. The base 6 may, possibly included into the stand 12, comprise a vertical adjustment mechanism for vertically adjusting (up/down) at least the seat 2, preferably the frame 8 and any attached parts e.g. the seat 2 and the backrest 4, with respect to the stand 12, such as a gas pressure spring setup. Also or alternatively, (the stand 12 of) the base 6 may provide a rotary arrangement allowing at least part of the chair 1, e.g. the frame 8 and any attached parts e.g. the seat 2 and the backrest 4, to rotate about a vertical axis A12. The chair 1 may further comprise arm rests (not shown).

In the chair 1, the seat 2, the backrest 4 and (the frame 8 of) the base 6 are movably coupled for reversible relative adjustment in a seating direction from a first configuration I for sitting in an upright posture (FIGS. 1, 5A, 5B) to a second configuration II for sitting in a reclined posture (FIGS. 7A, 7B) and in an intermediate configuration III (FIGS. 6A, 6B) providing an associated intermediate sitting postures in between. As will be discussed below, the shown embodiment may continuously accommodate any configuration between the first and second configurations I, II.

The chair 1 comprises a lever 14, which may also be referred to as "rocker" 14. The lever 14 is fixed to the base 6 at the protruding seat support 10 (see below) and rotary about a lever axis A14 transverse to the seating direction SD. Here, the rotary coupling is provided by a lever pivot 13 fitting a base recess 15, but an inverted coupling (base pivot and lever recess) or any other rotary coupling could be provided as well. Note that in other embodiments, not shown, the lever and base need not be fixed, and the lever axis may be movable with respect to the base, e.g. at least part of the lever rolling and/or translating in a front/back direction.

The lever 14 comprises a continuous lever support surface 16 and is provided with optional openings 18. In another embodiment, not shown, plural lever support surfaces could be provided. The lever comprises an opening 19 allowing passage of the seat support rotation 10 upon rotation of the lever 14 about the lever axis A14 (see below).

The lever support surface 16 is curved in a circumferential direction about the lever axis A14. In the shown embodiment, as options, the curvature has a circular shape and is arranged noncircular about the lever axis A14. The lever support surface 16 is also laterally curved, in a direction along the lever axis A14, turning upwards towards the left and right sides (L, R) (in the shown embodiment as options in an circular shape and left/right symmetric) so that the lever support surface 16 has a saddle shape, here being symmetric (FIGS. 2-4, 8).

The seat 2 is provided with a continuous support surface 20, here by means of an optional support member 22, and with optional protrusions 24. In another embodiment, plural support surfaces could be provided and/or the support surface(s) could be formed by (parts of) the seat without intervening support member 24.

The shape of the support surface 20 is curved in a circumferential direction about the lever axis A14. In the shown embodiment, as options, the curvature has a circular shape and is arranged noncircular about the lever axis A14. The support surface 20 is also laterally curved, in a direction along the lever axis A14, turning upwards towards the left and right sides (L, R) (in the shown embodiment as options in an circular shape and left/right symmetric) so that the support surface 20 has a saddle shape, here being symmetric (FIGS. 2-4, 8).

In the chair 1, the shapes of the lever support surface 16 and support surface 20 match and in assembled state (FIGS. 1, 5A-8, see also below) the lever support surface 16 and support surface 20 rest on each other and, in the first configuration, engage each other substantially throughout. Relative to the lever axis A14, in the first configuration, the lever 14 and support surface 20 define a front support portion 16F forward of the lever axis A14 and a rear support portion 16B rearward of the lever axis A14 together defining a curved shape (here having a circular shape but being arranged noncircular about the lever axis A14).

In assembled state of the chair 1, the protrusions 24 are accommodated in the openings 18 restricting relative movement of (the support member 22 of) the seat 2 and the lever 14 which may increase reliability and/or safety of the chair (see below).

In other embodiments, not shown, one or more elements may be placed between the support surface and the lever, e.g. a felt layer and/or one or more bearing layers.

In the shown embodiment, the seat 2 and the backrest 4 comprise a self-supporting shell, which may be formed by one or more felt layers and/or resilient plastic. The seat 2 and backrest 4 are resiliently flexible somewhat being shape-maintaining and supporting a sitting user but accommodating slight deformation under elevated pressure.

The backrest 4 is rotary coupled with the frame 8 of the base 6 with rotary backrest couplings 25 on laterally opposite sides so that the backrest is rotary relative to the base about a backrest axis A4 defined by the rotary backrest couplings 25. In other embodiments, a rotary coupling could be located elsewhere, e.g. in the middle of the backrest instead of on lateral sides as shown. A benefit of the locations of the rotary backrest couplings 25, being in front of a user contact surface of the backrest 4 in the shown embodiment is that the axis of rotation A4 may intersect the spine of a sitting user leaning against the backrest 4, this assists a natural sensation when tilting the backrest 4 about the backrest axis A4.

The seat 2 and the backrest 4 are reversibly movably coupled with rotary couplings 26 on laterally (L/R) opposite sides of the seat 2 and backrest 4, respectively, each having an axis of rotation A26. The axes of rotation A26 of the respective rotary couplings 26 are nonparallel and aim inward-upward with respect to a sitting user's position. Upon deformation of the seat 2 and backrest 4 (see below) each axis 26 may become reoriented (in particular, turning to a parallel orientation relative to each other) about a respective centre of reorientation rotation.

Figure 7A:
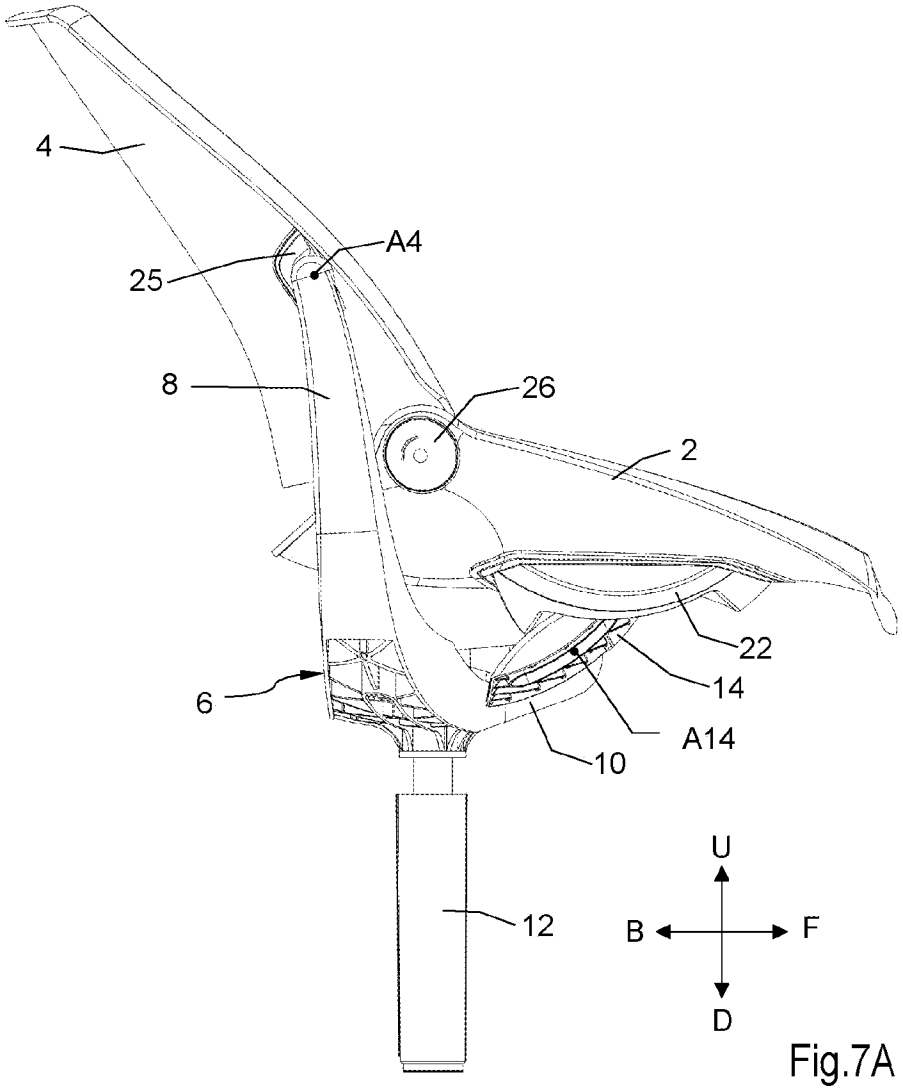
FIGS. 7A and 7B are views as in FIGS. 5A-5B and 6A-6B of the chair in a second configuration.
Figure 7B:
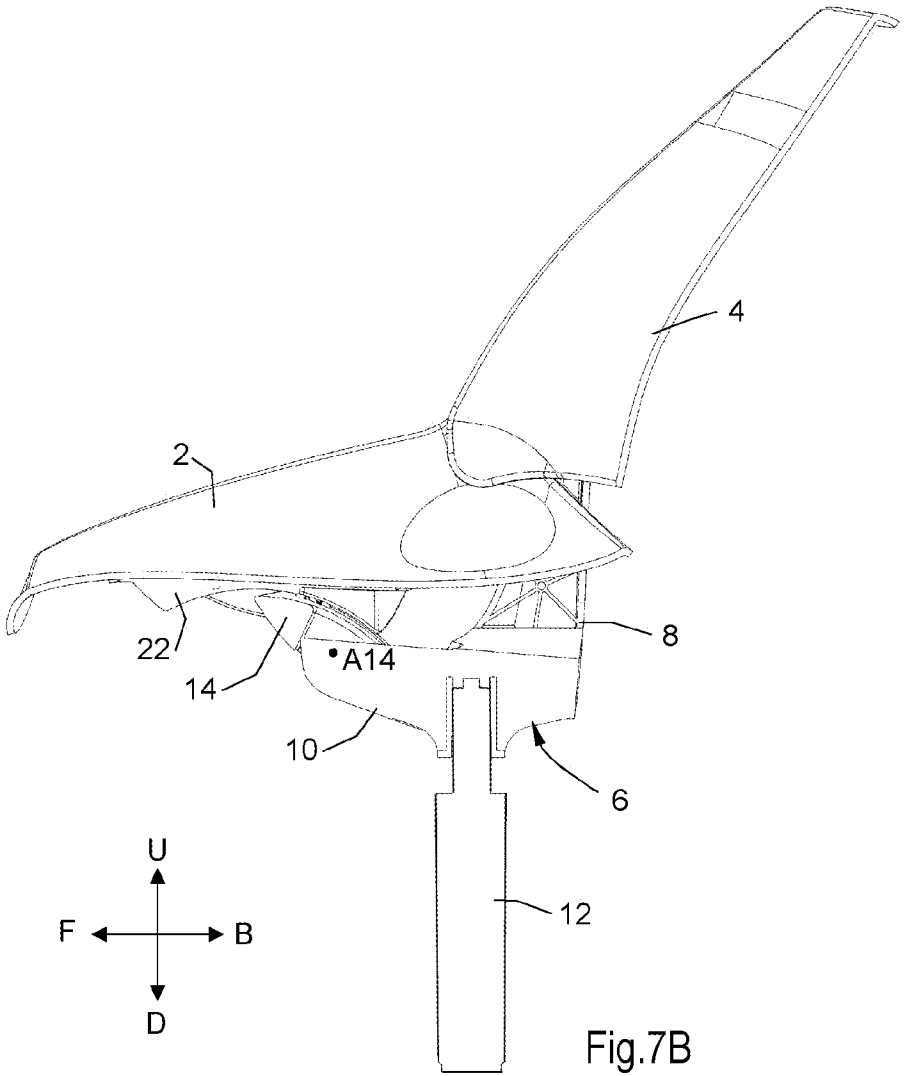

Referring now to FIGS. 5A-5B, 6A-6B, 7A-7B it may be seen that the backrest 4 may be rotated with respect to (the frame 8 of) the base 6 about the backrest axis A4 from the first configuration I (FIGS. 5A-5B) to the second configuration II (FIGS. 7A-7B) via an intermediate configuration III (FIGS. 6A-6B) so that an upper part of the backrest 4 moves backward (B direction) and a lower part of the backrest 4 moves forward (F direction). At the same time, since the seat 2 and the backrest 4 are movably coupled and the seat 2 is movably coupled with the lever 14 and the base 6, the seat 2 moves forward (F) relative to the base 6 and therefore relative to the lever axis 14. By the operable coupling of their respective lever support surface 16 and support surface 20, the seat support member 22 and the lever 14 cooperate and perform a combined motion about the lever axis A14. In the combined motion, the lever 14 is urged by a combination of forward and downward forces from the seat and possibly any user sitting on the seat, along a curved path defined by the combination of (lever) support surfaces 16 and 20, into rotation from a first orientation in the first configuration I (FIGS. 5A-5B) via an intermediate orientation (FIGS. 6A-6B) to a second orientation in the second configuration II (FIGS. 7A-7B). By the rotation, a front portion of the lever 14 rises and raises the front support portion 16F along the curved path defined by the respective cooperating supporting surfaces 16, of the lever 14 and support member 22. Thus the seat 2 is raised, staying supported on (the seat support 10 of) the base 6 via the lever 14 and the respective cooperating supporting surfaces 16, 20 of the lever 14 and support member 22. Therefore, together with the forward movement of the seat 2 relative to the base 6, the seat 2 is raised by a change from the first configuration I to the second configuration II. In addition, due to the rotary coupling between the seat 2 and backrest 4, the angle between the seat 2 and the backrest 4 is increased, opening up the seating angle and reducing or preventing raising at least the front edge of the seat so as not to lift the knees of a sitting user. In combination, an effect of a rotation of the seat 2 and backrest 4 about the hip joint of a sitting user is provided. Also at the same time, due the nonparallel axes of rotation A26 of the rotary couplings 26 will tend to align so that the seat 2 and backrest 4 deform slightly inward therewith increasing curvature of the seat 2 and backrest 4 thus increasing lateral confinement and sense of security of a sitting user.

The change from first to second configuration may be reversed by (attempt of) assuming a straight sitting up posture.

In other words, in the chair 1, the seat 2 is rotary coupled to the backrest 4 and the backrest 4 is rotary coupled to the base 6 about an axis of rotation A4. The seat 2 is suspended from the backrest 4 and movably supported on the rocker 14, providing a fulcrum to the seat 2. The rocker 14 is rotary coupled to the base 6 about an axis of rotation A14 and has a noncircular shape about its axis of rotation A14. Thus, upon rotation of the lever 14 about its axis of rotation A14, the position of the fulcrum changes relative to the base 6 and/or the seat 2. Rotation of the backrest 4 relative to the base 6 about the backrest axis A4 is associated with at least forward-backward translation of the seat 2 with respect to the base 6. The base 6, rocker 14, and seat 2 are movably coupled such that the translation of the seat 2 relative to the base 6 causes rotation of the rocker 14 about the axis of rotation A14 therewith causing a change in the position of the fulcrum along a curved path.

The upward arms of the frame 8 supporting the backrest couplings 25 are somewhat resiliently flexible, allowing sideways flexion and torsion of the frame 8 and backrest 4 about a vertical direction relative to the lower end of (the frame 8 of) the base 2, in particular the seat support 10. The flexion and/or torsion may be asymmetric with respect to the base 6 and in particular with respect to (an axis A12 of) the stand 12.

Since the support surface 20 and lever support surface 16 are operably coupled and shaped as described above, see FIG. 8, the seat is supported on the base by the lever a continuous range of configurations differing with respect to a relative rotation about an axis associated with the flexion and/or torsion which is generally perpendicular to the lever axis A14, both in the first and second configurations (I, II), and in between (III).

In the chair 1, the seat 2 (in particular the support member 22) and the lever 14 may be attached, e.g. by locking the protrusions 24 to the openings 18 (which then e.g. optionally may be though holes). However the seat may be separable from the base 6 and/or lever 14 to allow folding the chair 1 as shown in FIG. 9. Note that in another embodiment, not shown, the lever 14 may be attached to (the support member 22 of) the seat 2 and be detached from (the seat support 10 of) the base 2 as well. The folded configuration may be secured by appropriate means. E.g. a lock could be provided in one or both rotary couplings 26.

As may be seen in the Figures, at least part of the base 6 may comprise hollow members fortified with beams and/or ribs. This facilitates manufacturing by molding techniques.

Figure 10:
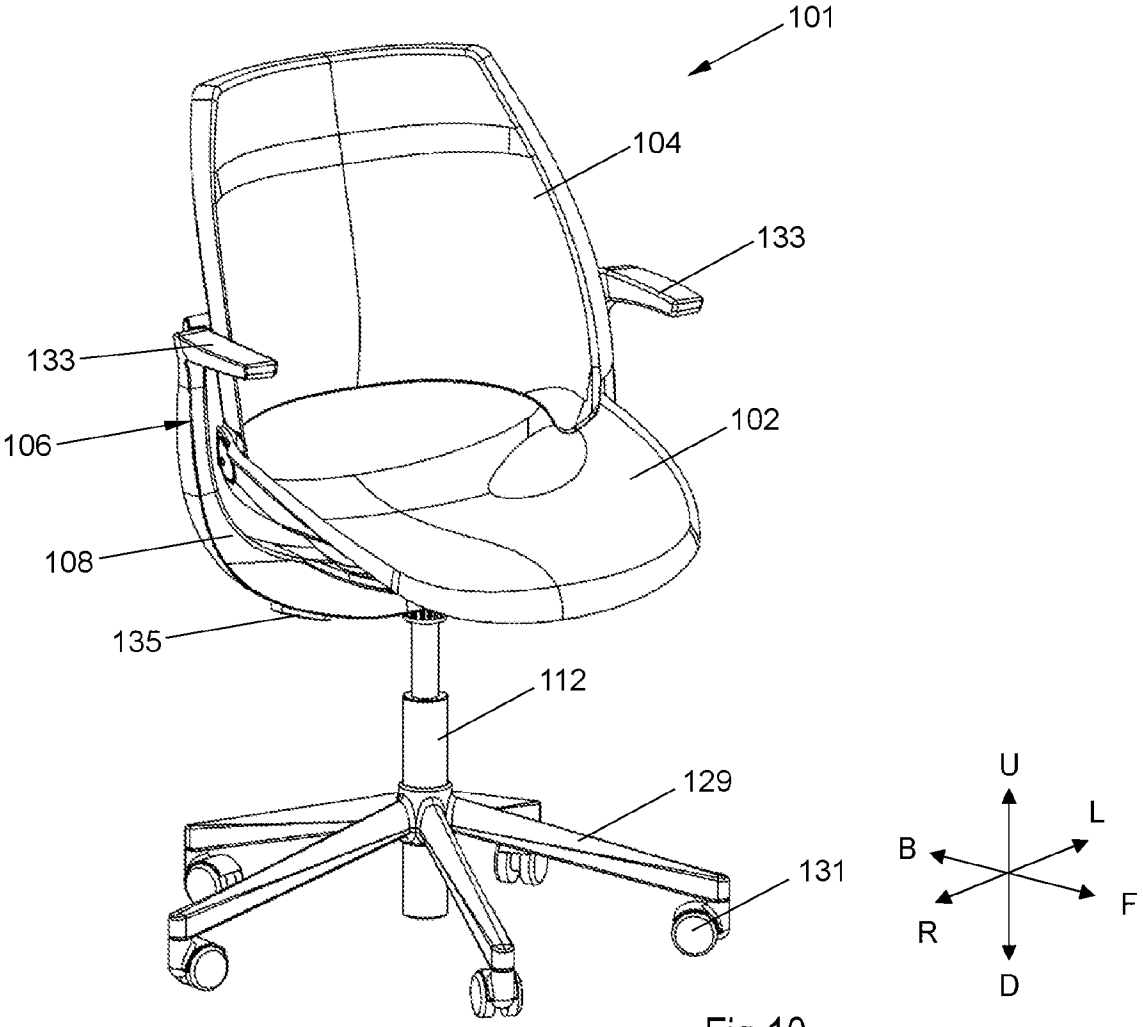
FIG. 10 shows another embodiment.

FIG. 10 shows a chair 101 as another embodiment. Like chair 1, the chair 101 comprises a seat 102 and a backrest 104. An adjustment mechanism comprising a lever and a support structure as discussed above is not shown; the chair 101 is otherwise substantially equal to the chair 1 of FIGS. 1-9 so that only relevant differences are discussed below. In FIG. 10 stand 112 is shown provided with a number of radial legs 129 each provided with a swivel wheel 131. Different from chair 1 of FIGS. 1-9, chair 101 comprises arm rests 133. As an option the arm rests 133 are integrally formed with the frame 108. However, the frame 8, 108 may be formed as an assembly of different parts. As one or more options, the arm rests may be formed and/or positioned differently and/or they may be adjustable, e.g. being detachably connected and/or hinged mounted to the frame 108 and/or other portions.

Also, a handle 135 for manipulation of a height adjustment system (not shown) in the stand 12 is visible, as an option being at least partly integrated in the frame 6.

The frames 8, 108 of the chairs 1, 100 may be formed in the same manner as a shell with fortification ribs. Also or alternatively, at least part of the frame, the lever and/or the base may be formed by injection molding with gas bubble injection. This technique allows creation of comparably large at least partly hollow structures that may be bent and of which structural characteristics may be well predefined. In particular the frame 108 with integrated arm rests may therefore be manufactured comparably low-cost. Preferred material for gas bubble injection molding may comprise or be, at least substantially, a polyamide (e.g. Nylon). Note that other manufacturing techniques such as insert molding and/or overmolding may be used, providing a core material and/or-structure surrounded by another material and/or-structure.

The disclosure is not restricted to the above described embodiments which can be varied in a number of ways within the scope of the claims. For instance the seat and/or backrest may have different shapes and/or could comprise plural layers and/or stuffing. Various parts of the chair may be assemblable, disassemblable and/or reassemblable without tools e.g. by releasable snap connections facilitating manufacturing, repair and/or recycling. The chair may comprise a head support. The frame may be formed differently.

Elements and aspects discussed for or in relation with a particular embodiment may be suitably combined with elements and aspects of other embodiments, unless explicitly stated otherwise.

The invention claimed is:

1. A piece of sitting furniture comprising:

a seat;

a backrest;

a base;

wherein the seat and the base are movably coupled for reversible relative adjustment in a seating direction from a first configuration for sitting in an upright posture to a second configuration for sitting in a reclined posture, wherein the piece of sitting furniture comprises one or more support surfaces and a lever supporting the seat on the base in at least the first and second configurations, wherein the lever is rotary about a horizontal lever axis transverse to the seating direction and comprises a first support portion defining a first lever arm about the lever axis and a second support portion defining a second lever arm about the lever axis movably engaging the one or more support surfaces at the first support portion and the second support portion, and the one or more support surfaces define a curved path that is curved about the lever axis, such that displacement of the one or more support surfaces relative to the lever axis in the seating direction causes rotation of the lever about the horizontal lever axis, wherein the lever comprises one or more lever support surfaces defining a curved lever path matching the curved path for supporting the one or more support surfaces along the curved path, and wherein the one or more support surfaces form a substantially continuous surface along the curved path including the first support portion and the second support portion, and/or wherein the one or more lever support surfaces form a substantially continuous surface along the curved lever path from the first support portion to the second support portion.

2. The piece of sitting furniture according to claim 1, wherein the one or more lever support surfaces engage the one or more support surfaces.

3. The piece of sitting furniture according to claim 1, wherein the curved path is circular.

4. The piece of sitting furniture according to claim 1, wherein the lever axis is fixed with respect to one of the base and the seat, and the one or more support surfaces are fixed with respect to the other one of the base and the seat.

5. The piece of sitting furniture according to claim 4, wherein the lever axis is fixed with respect to the base, and the one or more support surfaces are fixed with respect to the seat.

6. The piece of sitting furniture according to claim 1, wherein the seat and/or the backrest comprise a self-supporting shell and/or wherein the seat and/or the backrest comprise one or more felt layers.

7. The piece of sitting furniture according to claim 1, wherein the backrest is rotary coupled with the base about a backrest axis; and/or wherein the seat and the backrest are movably coupled for reversible combined motion from the first configuration into the second configuration.

8. The piece of sitting furniture according to claim 7, wherein the seat and the backrest are movably coupled for reversible combined motion from the first configuration into the second configuration by reversibly deformable couplings and/or rotary couplings defining non-parallel axes of rotation.

9. The piece of sitting furniture according to claim 8, wherein the seat and the backrest are rotary coupled for reversible combined motion from the first configuration into the second configuration.

10. The piece of sitting furniture according to claim 8, wherein the seat and the backrest are movably coupled for reversible combined motion from the first configuration into the second configuration by reversibly deformable couplings and/or rotary couplings on laterally opposite sides of the seat and backrest, respectively defining non-parallel axes of rotation.

11. A piece of sitting furniture comprising:

a seat:

a backrest;

a base;

wherein the seat and the base are movably coupled for reversible relative adjustment in a seating direction from a first configuration for sitting in an upright posture to a second configuration for sitting in a reclined posture, wherein the piece of sitting furniture comprises one or more support surfaces and a lever supporting the seat on the base in at least the first and second configurations, wherein the lever is rotary about a horizontal lever axis transverse to the seating direction and comprises a first support portion defining a first lever arm about the lever axis and a second support portion defining a second lever arm about the lever axis movably engaging the one or more support surfaces at the first support portion and the second support portion, and the one or more support surfaces define a curved path that is curved about the lever axis, such that displacement of the one or more support surfaces relative to the lever axis in the seating direction causes rotation of the lever about the horizontal lever axis, wherein the base comprises a frame; and wherein the frame supports the backrest on laterally opposite sides, and/or wherein the frame and backrest are rotary coupled on laterally opposite sides, and/or wherein at least part of the base and/or the backrest is at least partially resilient, allowing sideways flexion and/or torsion about a vertical axis of rotation of at least part of the seat and/or backrest.

12. The piece of sitting furniture according to claim 1, wherein at least part of the seat and at least part of the base are movably coupled for reversible relative rotation about a vertical axis of rotation.

13. The piece of sitting furniture according to claim 1, wherein the one or more support surfaces and the lever are operably coupled to support the seat on the base in at least two configurations differing with respect to a relative rotation about an axis generally perpendicular to the lever axis.

14. The piece of sitting furniture according to claim 13, wherein at least part of the lever defines a curved lever support surface being curved in a direction parallel to the axis generally perpendicular to the lever axis and to the lever axis in a plane spanned by both these axes.

15. The piece of sitting furniture according to claim 14, wherein the one or more support surfaces define a curved support surface being curved a direction parallel to the lever axis.

16. The piece of sitting furniture according to claim 1, being foldable, the seat being reversibly adjustable to a relatively vertical orientation.

17. The piece of sitting furniture according to claim 16, wherein the seat is stable in the relatively vertical orientation and/or the seat is reversibly fixable in the relatively vertical orientation so as to maintain the orientation.

18. The piece of sitting furniture according to claim 1, wherein at least part of the base is provided with a vertical adjustment mechanism for vertically adjusting at least part of the seat with respect to the base; and/or wherein the base comprises one or more wheels; and/or wherein the piece of sitting furniture comprises arm rests.

19. A chair comprising:

a seat;

a backrest;

a base;

wherein the seat and the base are movably coupled for reversible relative adjustment in a seating direction from a first configuration for sitting in an upright posture to a second configuration for sitting in a reclined posture, wherein the piece of sitting furniture comprises one or more support surfaces and a lever supporting the seat on the base in at least the first and second configurations, wherein the lever is rotary about a horizontal lever axis transverse to the seating direction and comprises a first support portion defining a first lever arm about the lever axis and a second support portion defining a second lever arm about the lever axis movably engaging the one or more support surfaces at the first support portion and the second support portion, and the one or more support surfaces define a curved path that is curved about the lever axis, such that displacement of the one or more support surfaces relative to the lever axis in the seating direction causes rotation of the lever about the horizontal lever axis, and wherein the seat and the backrest are movably coupled for reversible combined motion from the first configuration into the second configuration by reversibly deformable couplings and/or rotary couplings defining non-parallel axes of rotation.

* * * * *